United States Patent [19]

Meeusen

[11] 4,316,426

[45] Feb. 23, 1982

[54] STRUCTURE FOR THE MOORING OF YACHTS AND SIMILAR CRAFT

[76] Inventor: Pieter Meeusen, Barendrechtseweg 30, 2992 XB Barendrecht, Netherlands

[21] Appl. No.: 28,922

[22] Filed: Apr. 10, 1979

[30] Foreign Application Priority Data

Jan. 19, 1979 [NL] Netherlands ..... 7900463

[51] Int. Cl.[3] ..... B63B 35/00

[52] U.S. Cl. ..... 114/263; 52/222; 52/822; 405/219

[58] Field of Search ..... 114/267, 263, 266; 405/218, 219, 220, 221; 52/824, 825, 222, 822; 411/338, 339, 427

[56] References Cited

U.S. PATENT DOCUMENTS

| | | | |
|---|---|---|---|
| 2,183,451 | 12/1939 | Förster | 52/222 |
| 2,383,133 | 8/1945 | Kost | 411/427 X |
| 2,571,337 | 10/1951 | Burnham | 405/218 |
| 2,609,069 | 9/1952 | McLaughlin | 85/4 |
| 3,009,326 | 11/1961 | Williams | 114/267 X |
| 3,147,727 | 9/1964 | Weiss, Jr. et al. | 114/266 |
| 3,462,114 | 8/1969 | O'Dell, Sr. et al. | 85/4 |
| 3,967,569 | 7/1976 | Shorter, Jr. | 114/266 |
| 4,078,515 | 3/1978 | Svirklys | 405/219 X |

FOREIGN PATENT DOCUMENTS

| | | | |
|---|---|---|---|
| 1523455 | 5/1968 | France | 114/266 |

*Primary Examiner*—Sherman D. Basinger
*Attorney, Agent, or Firm*—Young & Thompson

[57] ABSTRACT

Structure for berthing marine craft, yachts and the like, comprises longitudinal beams supporting transverse boards for walking on. A retaining strip of L-shaped cross section covers the end edges of the boards and is secured to the beams by nut and bolt assemblies that pass through the beams and retaining strips and serve as distance pieces between adjacent boards. A wooden wale is also bordered along its upper edge by the downwardly depending flange of the retaining strip. Central portions of the boards are pressed upwardly against the restraining influence of the retaining strips, to maintain the boards regular under all conditions, and also to strengthen the boards by prestressing them.

5 Claims, 2 Drawing Figures

STRUCTURE FOR THE MOORING OF YACHTS AND SIMILAR CRAFT

Figure 1:
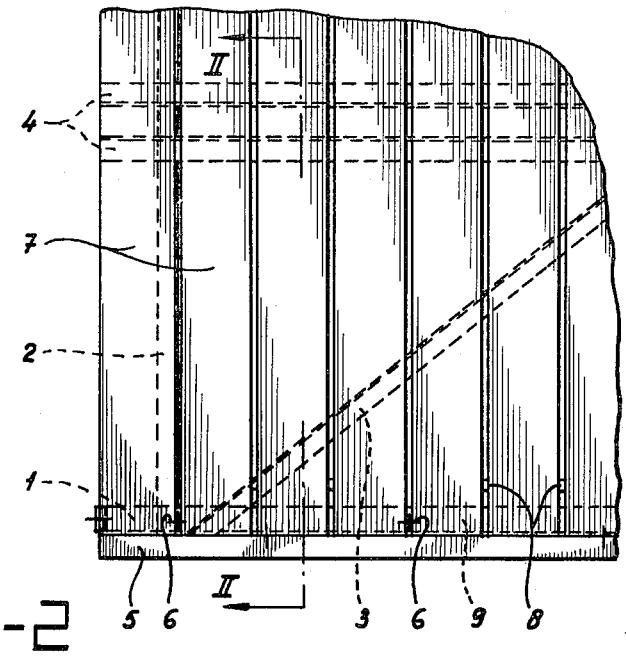

This invention relates to a structure for berthing marine craft, yachts and the like, comprising longitudinal beams and transverse boards on which persons may walk. It is known for such structures to secure the transverse boards to longitudinal beams or to wales by screws or bolts extending vertically through the boards. Such wales may be secured to the outside of the longitudinal beams. Such connections of the transverse boards often work loose, which is promoted by the fact that the structure, particularly if it is floating, is exposed to torsion about a horizontal longitudinal axis.

The present invention aims at avoiding this disadvantage and improviding the manner in which the transverse boards are connected by proposing a simple structure allowing rapid and easy replacement of the boards and allowing them to shrink or expand.

In view thereof a structure as indicated above is according to the invention characterized in that the boards are maintained in their correct position in longitudinal direction of the structure by abutment members positioned between adjacent boards and that the boards are enclosed in a vertical direction by retaining strips extending parallel to each longitudinal beam and positioned above them, engaging on the terminal edges of the boards.

It is thus possible to use boards without openings therethrough and after removing the retaining strips or parts thereof the boards may easily be removed, replaced and put in position. It is now possible to allow differences in lengths of the boards because they need not be enclosed with their terminal edges but only from above.

Preferably the retaining strips according to the invention extend both above the terminal edges of the boards and to the side thereof to protect these edges against damage. Particularly if along the outside of the longitudinal beams of the structure there is a wale protruding above the longitudinal beam it is preferred that the retaining strip has the transverse section of an angle iron, of which the downwardly protruding leg borders the upwardly protruding part of the wale. The wale in this case also serves to position the retaining strip, which facilitates assembly.

If the boards are thus positioned in a way so that they are entirely loose, i.e. not under pressure at their terminal edges by pressure of the retaining strips thereon, differences in temperature, humidity etc. will easily give a walking surface on the boards which is irregular. In view thereof the invention proposes as a preferred embodiment to give the transverse boards a support on the structure below it also between their ends, which supports these boards at a higher level than the retaining strips and supports near the terminal edges of the boards, so that the boards are under tension in an upwardly somewhat curved shape. This also increases the strength of the boards by the pre-stress thus generated.

The said abutments are preferably also used to secure the retaining strips in place, as will be described.

Figure 2:
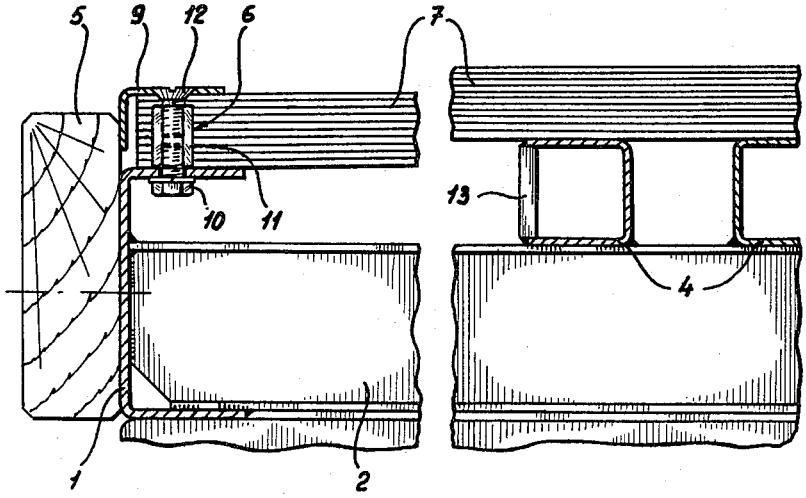

A preferred embodiment of the structure of the invention is shown in the enclosed drawing and will now be explained in more detail. In said drawing:

FIG. 1 is a partial view from above of part of a pier or jetty according to the invention, and FIG. 2 is a transverse section of part thereof along the line II—II in FIG. 1 at a larger scale and with parts broken away.

The structure, in this case a pier or jetty, along each longitudinal edge has a longitudinal beam 1 and these beams are connected by transverse beams 2 and 3. Near the central part of the structure two longitudinal beams 4 rest on the beams 2 and 3.

The beams 1 are suitably supported, either by a structure resting on the bottom, on piles driven in the earth below the structure or on floats to make the structure floating in the water. Such floats may be fully closed casings of metal, plastic material or the like.

Wales 5 of wood are provided along the outside of the beams 1, are rigidly connected thereto by means not shown in detail and protrude upwardly over some distance above the top of the beams 1. Bolts 6 connected to beams 1 secure retaining strips 9 to said beams and said strips enclose the ends of the transverse boards 7, preferably of wood, between themselves and said beams 1. The bolts 6 extend through the space between two adjacent boards and thus keep them in position also in longitudinal direction of the structure. There are, however, bolts 6 between only some of the boards, as is clear from FIG. 1, and between boards where there are no bolts 6 one of the adjacent boards has distance lugs 8 to keep the boards mutually in the correct position.

As appears from FIG. 2 the longitudinal beams 1 are preferably of U-shape or channel beams in cross-section. The bolts 6 consist of three parts, the central part 11 being a hexagonal high nut with a throughgoing threaded bore. The lower part 10 is a bolt extending through the top flange of beam 1 and clamping the nut 11 to said flange.

The retaining strips 9 are embodied as long angle irons, preferably of steel, the top parts 12 of the bolts 6, embodied as bolts with recessed head, extending through the horizontal leg of said strips to push said strips downwardly onto the terminal edges of the boards 7. The upstanding downwardly pointing legs of said angle irons 9 extend along the inside of the wales 5.

The longitudinal beams 4 in the central part of the structure are also U-shaped or channel beams on their side. They may be provided at distances with strips or pins 13 welded to the flanges to allow storing and easy introduction of ducts or conductors for electricity, for telephone connections, for water etc. in said beams. Said beams 4 are secured to the transverse beams 2 and 3 and have their top surfaces in a position somewhat higher than the top faces of the retaining strips 9. This difference in height may for instance, for a length of the boards 7 of 170 cm, be 35 mm. Thereby the boards 7 are curved convexly upwardly somewhat and kept under stress. There might be only one such a beam 4 near the centre or, for wider structures, there may for instance be two such beams at distances of about one third of the width of the structure away from each other and from the side edges.

What I claim is:

1. A structure for berthing marine craft comprising longitudinal beams and transverse boards for walking thereon between such beams, characterized in that an elongated retaining strip extends parallel to and above the longitudinal beams and engages the upper sides of the terminal edges of the boards to retain them in vertical direction, the retaining strips extending both above and alongside the transverse terminal edges of the boards, and in that fastening means extend upwardly from the longitudinal beams between two adjacent boards and engage the retaining strips in order to secure them and to press them downwardly onto the upper sides of the terminal edges of the transverse boards, the transverse boards being free from any member that penetrates them to hold them in place.

2. A structure according to claim 1, and abutment members between adjacent boards to space said adjacent boards apart.

3. A structure according to claim 2, in which said fastening means comprise some of said abutment members.

4. A structure according to claim 1 in which along the outside of the longitudinal beams a wale is provided protruding above the longitudinal beam, characterized in that the adjacent retaining strip is an angle iron in cross-section bordering with its downwardly directed leg the protruding part of the wale, the top of the wale extending higher than the lower edge of said downwardly directed leg.

5. A structure for berthing marine craft comprising longitudinal beams and transverse boards for walking thereon between such beams, characterized in that an elongated retaining strip extends parallel to and above the longitudinal beams and engages the upper sides of the terminal edges of the boards to retain them in vertical direction, the retaining strips extending both above and alongside the transverse terminal edges of the boards, and in that fastening means extend upwardly from the longitudinal beams between two adjacent boards and engage the retaining strips in order to secure them and to press them downwardly onto the upper sides of the terminal edges of the transverse boards, and a support for the transverse boards, disposed between the longitudinal beams and supporting the transverse boards at a higher level than the terminal edges of the boards are supported by the retaining strips and supports below them so that the boards are stressed in a somewhat upwardly curved position.

* * * * *